US009309586B2

(12) United States Patent
Fushiwaki et al.

(10) Patent No.: US 9,309,586 B2
(45) Date of Patent: Apr. 12, 2016

(54) HIGH-STRENGTH GALVANIZED STEEL SHEET AND METHOD FOR MANUFACTURING THE SAME

(75) Inventors: Yusuke Fushiwaki, Fukuyama (JP); Yoshiharu Sugimoto, Chiba (JP); Masahiro Yoshida, Kawasaki (JP); Yoshitsugu Suzuki, Fukuyama (JP)

(73) Assignee: JFE Steel Corporation, Tokyo (JP)

( * ) Notice: Subject to any disclaimer, the term of this patent is extended or adjusted under 35 U.S.C. 154(b) by 16 days.

(21) Appl. No.: 13/258,209

(22) PCT Filed: Mar. 30, 2010

(86) PCT No.: PCT/JP2010/056116

§ 371 (c)(1), (2), (4) Date: Sep. 21, 2011

(87) PCT Pub. No.: WO2010/114142

PCT Pub. Date: Oct. 7, 2010

(65) Prior Publication Data

US 2012/0018060 A1 Jan. 26, 2012

(30) Foreign Application Priority Data

Mar. 31, 2009 (JP) ..... 2009-085197

(51) Int. Cl.

| | |
|---|---|
| ***C23C 2/06*** | (2006.01) |
| ***C23C 2/12*** | (2006.01) |
| ***C21D 1/26*** | (2006.01) |
| ***C21D 9/46*** | (2006.01) |
| ***C21D 9/56*** | (2006.01) |
| ***C22C 1/00*** | (2006.01) |
| ***C23C 2/02*** | (2006.01) |
| ***C23C 2/28*** | (2006.01) |
| ***C23C 2/40*** | (2006.01) |

(52) U.S. Cl.

CPC ... *C23C 2/12* (2013.01); *C21D 1/26* (2013.01); *C21D 9/46* (2013.01); *C21D 9/561* (2013.01); *C22C 1/002* (2013.01); *C23C 2/02* (2013.01); *C23C 2/06* (2013.01); *C23C 2/28* (2013.01); *C23C 2/40* (2013.01); *C21D 2211/004* (2013.01); *C21D 2211/005* (2013.01)

(58) Field of Classification Search

CPC ..... C22C 2/06; C23C 2/06

USPC ..... 148/330, 332, 333, 337, 533

See application file for complete search history.

(56) References Cited

U.S. PATENT DOCUMENTS

2004/0234807 A1* 11/2004 Suzuki et al. ..... 428/659

FOREIGN PATENT DOCUMENTS

| | | | |
|---|---|---|---|
| EP | 1 482 066 | A2 | 12/2004 |
| EP | 1 980 638 | A1 | 10/2008 |
| EP | 2 412 842 | A1 | 2/2012 |
| JP | 06306561 | A | 11/1994 |
| JP | 07316762 | A | 12/1995 |
| JP | 08246121 | A | 9/1996 |
| JP | 2004315960 | | 11/2004 |
| JP | 2004323970 | | 11/2004 |
| JP | 2006097094 | A | 4/2006 |
| JP | 2006233333 | | 9/2006 |
| JP | 2008-156734 | A | 7/2008 |
| WO | WO-03074751 | A1 | 9/2003 |

OTHER PUBLICATIONS

English language machine translation of JP 07-316762 to Kawanishi et al. Generated Jul. 24, 2013.*

J.W. Smith, "Types of Heat-Treating Furnaces," Heat Treating, vol. 4, ASM Handbook, ASM International, 1991, p. 465-474.*

Translation of JP07-316762 to Kawanishi et al. Translated by Phoenix Translations. Prepared Sep. 2014.*

International Application Serial No. PCT/JP2010/056116, International Search Report mailed Apr. 27, 2010, 2 pgs.

International Search Report dated Jul. 3, 2014, application No. EP 10 75 8907.

* cited by examiner

*Primary Examiner* — Brian Walck

(74) *Attorney, Agent, or Firm* — RatnerPrestia

(57) ABSTRACT

Provided is a method for manufacturing a high-strength galvanized steel sheet, made from a steel sheet containing Si and/or Mn, having excellent exfoliation resistance during heavy machining. When a steel sheet containing 0.01% to 0.18% C, 0.02% to 2.0% Si, 1.0% to 3.0% Mn, 0.001% to 1.0% Al, 0.005% to 0.060% P, and 0.01% or less S on a mass basis, the remainder being Fe and unavoidable impurities, is annealed and galvanized in a continuous galvanizing line, a temperature region with a furnace temperature of A° C. to B° C. ($600 \leq A \leq 780$ and $800 \leq B \leq 900$) is performed at an atmosphere dew-point temperature of −5° C. or higher in a heating process.

4 Claims, No Drawings

HIGH-STRENGTH GALVANIZED STEEL SHEET AND METHOD FOR MANUFACTURING THE SAME

CROSS-REFERENCE TO RELATED APPLICATIONS

This application is the U.S. National Phase application of PCT International Application No. PCT/JP2010/056116, filed Mar. 30, 2010, and claims priority to Japanese Patent Application No. 2009-085197, filed Mar. 31, 2009, the disclosures of which PCT and priority applications are incorporated herein by reference in their entirely for all purposes.

FIELD OF THE INVENTION

The present invention relates to a high-strength galvanized steel sheet, made from a high-strength steel sheet containing Si and/or Mn, having excellent workability and also relates to a method for manufacturing the same.

BACKGROUND OF THE INVENTION

In recent years, surface-treated steel sheets made by imparting rust resistance to base steel sheets, particularly galvanized steel sheets and galvannealed steel sheets, have been widely used in fields such as automobiles, home appliances, and building materials. In view of the improvement of automotive fuel efficiency and the improvement of automotive crash safety, there are increasing demands for lightweight high-strength automobile bodies made from automobile body materials having high strength and reduced thickness. Therefore, high-strength steel sheets are being increasingly used for automobiles.

In general, galvanized steel sheets are manufactured in such a manner that thin steel sheets manufactured by hot-rolling and cold-rolling slabs are used as base materials and base steel sheets are recrystallization-annealed and galvanized in an annealing furnace placed in a continuous galvanizing line (hereinafter referred to as CGL). Galvannealed steel sheets are manufactured in such a manner that alloying is performed after galvanizing.

Examples of the type of the annealing furnace in the CGL include a DFF (direct fired furnace) type, a NOF (non-oxidizing furnace) type, and an all-radiant tube type. In recent years, CGLs equipped with all-radiant tube-type furnaces have been increasingly constructed because the CGLs are capable of manufacturing high-quality plated steel sheets at low cost due to ease in operation and rarely occurring pick-up. Unlike DFFs (direct fired furnaces) and NOFs (non-oxidizing furnaces), the all-radiant tube-type furnaces have no oxidizing step just before annealing and therefore are disadvantageous in ensuring the platability of steel sheets containing oxidizable elements such as Si and Mn.

In a method for manufacturing a hot-dipped steel sheet made from a high-strength steel sheet containing large amounts of Si and Mn, PTLs 1 and 2 disclose a technique in which a surface layer of a base metal is internally oxidized in such a manner that the heating temperature in a reducing furnace is determined by a formula given by the partial pressure of steam and the dew-point temperature is increased. However, since an area for controlling the dew-point temperature is intended for the whole furnace, the control of the dew-point temperature and stable operation are difficult. The manufacture of a galvannealed steel sheet under the unstable control of the dew-point temperature causes the uneven distribution of internal oxides formed in a base steel sheet and may possibly cause failure including uneven plating wettability and uneven alloying.

PTL 3 discloses a technique in which coating appearance is improved in such a manner that a surface layer of a base metal is internally oxidized just before plating and is inhibited from being externally oxidized by regulating not only the concentrations of $H_2O$ and $O_2$, which act as oxidizing gases, but also the concentration of $CO_2$. In the case where a large amount of Si is contained as disclosed in PTL 3, the presence of internal oxides is likely to cause cracking during machining, leading to a reduction in exfoliation resistance. A reduction in corrosion resistance is also caused. Furthermore, there is a concern that $CO_2$ causes problems such as furnace contamination and changes in mechanical properties due to the carburization of steel sheets.

Recently, high-strength galvanized steel sheets and high-strength galvannealed steel sheets have been increasingly used for parts difficult to machine and therefore exfoliation resistance during heavy machining has become important. In particular, in the case of bending a plated steel sheet to more than 90 degrees such that the plated steel sheet forms an acute angle or in the case of machining the plated steel sheet by impact, the exfoliation of a machined portion needs to be suppressed.

In order to satisfy such a property, it is necessary to achieve a desired steel microstructure by adding a large amount of Si to steel and it is also necessary to highly control the microstructure and texture of a surface layer of a base metal lying directly under a plating layer which may crack during heavy machining. However, such control is difficult for conventional techniques; hence, a galvanized steel sheet with excellent exfoliation resistance during heavy machining has not been capable of being manufactured from a Si-containing high-strength steel sheet in a CGL equipped with an annealing furnace that is an all-radiant tube-type furnace.

PATENT LITERATURE

PTL 1: Japanese Unexamined Patent Application Publication No. 2004-323970

PTL 2: Japanese Unexamined Patent Application Publication No. 2004-315960

PTL 3: Japanese Unexamined Patent Application Publication No. 2006-233333

SUMMARY OF THE INVENTION

The present invention provides a high-strength galvanized steel sheet, made from a steel sheet containing Si and/or Mn, having excellent coating appearance and excellent exfoliation resistance during heavy machining and provides a method for manufacturing the same.

Since an inner portion of a steel sheet has been excessively oxidized in such a manner that the partial pressure of steam in an annealing furnace is increased and thereby the dew-point temperature thereof is increased, cracking has been likely to occur during machining as described above, leading to a reduction in exfoliation resistance. Therefore, the inventors have investigated ways to solve this problem by a novel method different from conventional approaches. As a result, the inventors have found that a high-strength galvanized steel sheet having excellent coating appearance and excellent exfoliation resistance during heavy machining can be obtained in such a manner that the texture and microscope of a surface layer of a base metal lying directly under a plating layer are highly controlled because cracking and the like can occur in the plating layer during heavy machining. In particular, galvanizing is performed in such a manner that the dew-point temperature of an atmosphere is controlled to −5° C. or higher in a limited temperature region with a furnace temperature of A° C. to B° C. (600≤A≤780 and 800≤B≤900) in a heating process. Such an operation can suppress selective surface oxidation to suppress surface concentration and therefore a high-strength galvanized steel sheet having excellent coating appearance and excellent exfoliation resistance during heavy machining is obtained.

Herein, excellent coating appearance refers to appearance free from non-plating or uneven alloying.

A high-strength galvanized steel sheet obtained by the above method has a texture or microstructure in which an oxide of at least one or more selected from the group consisting of Fe, Si, Mn, Al, P, B, Nb, Ti, Cr, Mo, Cu, and Ni is formed in a surface portion of a steel sheet that lies directly under a plating layer and that is within 100 μm from a surface of a base steel sheet at 0.010 g/m$^2$ to 0.50 g/m$^2$ per unit area and a crystalline Si oxide, a crystalline Mn oxide, or a crystalline Si—Mn complex oxide is precipitated in base metal grains that are present in a region within 10 μm down from the plating layer and that are within 1 μm from grain boundaries. This enables the stress relief of a surface layer of a base metal and the prevention of cracking in the base metal surface layer during bending, leading to excellent coating appearance and excellent exfoliation resistance during heavy machining.

The present invention is based on the above finding and preferred features thereof are as described below.

(1) A method for manufacturing a high-strength galvanized steel sheet including a zinc plating layer, having a mass per unit area of 20 g/m$^2$ to 120 g/m$^2$, disposed on a steel sheet containing 0.01% to 0.18% C, 0.02% to 2.0% Si, 1.0% to 3.0% Mn, 0.001% to 1.0% Al, 0.005% to 0.060% P, and 0.01% or less S on a mass basis, the remainder being Fe and unavoidable impurities, includes annealing and galvanizing the steel sheet in a continuous galvanizing line. A temperature region with a furnace temperature of A° C. to B° C. is performed at an atmosphere dew-point temperature of −5° C. or higher in a heating process, where 600≤A≤780 and 800≤B≤900.

(2) In the method for manufacturing the high-strength galvanized steel sheet specified in Item (1), the steel sheet further contains at least one or more selected from the group consisting of 0.001% to 0.005% B, 0.005% to 0.05% Nb, 0.005% to 0.05% Ti, 0.001% to 1.0% Cr, 0.05% to 1.0% Mo, 0.05% to 1.0% Cu, and 0.05% to 1.0% Ni on a mass basis as a component composition.

(3) The method for manufacturing the high-strength galvanized steel sheet specified in Item (1) or (2) further includes alloying the steel sheet by heating the steel sheet to a temperature of 450° C. to 600° C. after galvanizing such that the content of Fe in the zinc plating layer is within a range from 7% to 15% by mass.

(4) A high-strength galvanized steel sheet is manufactured by the method specified in any one of Items (1) to (3). In the high-strength galvanized steel sheet, an oxide of at least one or more selected from the group consisting of Fe, Si, Mn, Al, P, B, Nb, Ti, Cr, Mo, Cu, and Ni is formed in a surface portion of the steel sheet that lies directly under the zinc plating layer and that is within 100 μm from a surface of a base steel sheet at 0.010 g/m$^2$ to 0.50 g/m$^2$ per unit area and a crystalline Si oxide, a crystalline Mn oxide, or a crystalline Si—Mn complex oxide is present in grains that are present in a region within 10 μm from a surface of the base steel sheet directly under the plating layer and that are within 1 μm from grain boundaries in the base steel sheet.

The term "high strength" as used herein refers to a tensile strength TS of 340 MPa or more. Examples of a high-strength galvanized steel sheet according to embodiments of the present invention include plated steel sheets (hereinafter referred to as GIs in some cases) that are not alloyed after galvanizing and plated steel sheets (hereinafter referred to as GAs in some cases) that are alloyed.

According to exemplary embodiments of the present invention, a high-strength galvanized steel sheet having excellent coating appearance and excellent exfoliation resistance during heavy machining is obtained.

DESCRIPTION OF EMBODIMENTS

The present invention will now be described in detail with reference to embodiments selected for illustration. In descriptions below, the content of each element in the component composition of steel and the content of each element in the component composition of a plating layer are in "% by mass" and are expressed simply in "%" unless otherwise specified.

First, annealing atmosphere conditions determining the surface structure of a base steel sheet lying directly under the plating layer are described below.

Galvanizing is performed in such a manner that the dew-point temperature of an atmosphere is controlled to −5° C. or higher in a limited temperature region with a furnace temperature of A° C. to B° C. (600≤A≤780 and 800≤B≤900) in a heating process in an annealing furnace, whereby an appropriate amount of an oxide (hereinafter referred to as an internal oxide) of an oxidizable element (such as Si or Mn) is allowed to present in an inner portion within 10 μm from a surface layer of a steel sheet and the selective surface oxidation (hereinafter referred to as surface concentration) of Si, Mn, or the like which deteriorates galvanizing and the wettability of the steel sheet after annealing and which is present in the surface layer of the steel sheet can be suppressed.

Reasons for setting the minimum temperature A to 600≤A≤780 are as described below. In a temperature region lower than 600° C., surface concentration is slight and therefore the wettability between molten zinc and the steel sheet is not reduced even if the dew-point temperature is not controlled or an internal oxide is not formed. In the case of increasing the temperature to higher than 780° C. without controlling the dew-point temperature, surface concentration is heavy and therefore the inward diffusion of oxygen is inhibited and internal oxidation is unlikely to occur. Thus, the dew-point temperature needs to be controlled to −5° C. or higher from a temperature region not higher than at least 780° C. Therefore, the allowable range of A is given by 600≤A≤780 and A is preferably a small value within this range.

Reasons for setting the maximum temperature B to 800≤B≤900 are described below. A mechanism suppressing surface concentration is as described below. The formation of the internal oxide allows a region (hereinafter referred to as a depletion layer) in which the amount of a solid solution of the oxidizable element (Si, Mn, or the like) in the inner portion within 10 μm from the surface layer of the steel sheet is reduced to be formed, whereby the surface diffusion of the oxidizable element from steel is suppressed. In order to form the internal oxide and in order to form the depletion layer sufficiently to suppress surface concentration, B needs to be set to 800≤B≤900. When B is lower than 800° C., the internal oxide is not sufficiently formed. When B is higher than 900° C., the amount of the formed internal oxide is excessive; hence, cracking is likely to occur during machining and exfoliation resistance is deteriorated.

Reasons for setting the dew-point temperature of the temperature region from A° C. to B° C. to −5° C. or higher are as described below. An increase in dew-point temperature increases the potential of $O_2$ produced by the decomposition of $H_2O$ and therefore internal oxidation can be promoted. In a temperature region lower than −5° C., the amount of the formed internal oxide is small. The upper limit of the dew-point temperature is not particularly limited. When the dew-point temperature is higher than 90° C., the amount of an oxide of Fe is large and walls of the annealing furnace and/or rollers may possibly be deteriorated. Therefore, the dew-point temperature is preferably 90° C. or lower.

The component composition of the high-strength galvanized steel sheet according to embodiments of the present invention is described below.

C: 0.01% to 0.18%

C forms martensite, which is a steel microstructure, to increase workability. Therefore, the content thereof needs to be 0.01% or more. However, when the content thereof is more than 0.18%, weldability is deteriorated. Thus, the content of C is 0.01% to 0.18%.

Si: 0.02% to 2.0%

Si strengthens steel and therefore is an element effective in achieving good material quality. In order to achieve the strength intended in embodiments of the present invention, the content thereof needs to be 0.02% or more. When the content of Si is less than 0.02%, a strength within the scope of the present invention cannot be easily achieved or there is no problem with exfoliation resistance during heavy machining. In contrast, when the content thereof is more than 2.0%, it is difficult to improve exfoliation resistance during heavy machining. Thus, the content of Si is 0.02% to 2.0%.

Mn: 1.0% to 3.0%

Mn is an element effective in increasing the strength of steel. In order to ensure mechanical properties and strength, the content thereof needs to be 1.0% or more. However, when the content thereof is more than 3.0%, it is difficult to ensure weldability and the adhesion of the coating and to ensure the balance between strength and ductility. Thus, the content of Mn is 1.0% to 3.0%.

Al: 0.001% to 1.0%

Al is an element more thermally oxidizable than Si and Mn and therefore forms a complex oxide together with Si or Mn. The presence of Al has the effect of promoting the internal oxidation of Si and Mn present directly under a surface layer of a base metal as compared with the absence of Al. This effect is achieved when the content is 0.001% or more. However, when the content is more than 1.0%, costs are increased. Thus, the content of Al is 0.001% to 1.0%.

P: 0.005% to 0.060%

P is one of unavoidably contained elements. In order to adjust the content thereof to less than 0.005%, costs may possibly be increased; hence, the content thereof is 0.005% or more. However, when the content of P is more than 0.060%, weldability is deteriorated and surface quality is also deteriorated. In the case of not performing alloying, the adhesion of the coating is deteriorated. In the case of performing alloying, a desired degree of alloying cannot be achieved unless the temperature of alloying is increased. In the case of increasing the temperature of alloying for the purpose of achieving a desired degree of alloying, ductility is deteriorated and the adhesion of the alloyed coating is also deteriorated; hence, a desired degree of alloying, good ductility, and the alloyed coating cannot be balanced. Thus, the content of P is 0.005% to 0.060%.

S≤0.01%

S is one of the unavoidably contained elements. When the content thereof is large, weldability is deteriorated. Therefore, the content thereof is preferably 0.01% or less although the lower limit thereof is not specified.

In order to control the balance between strength and ductility, the following element may be added as required: at least one or more selected from the group consisting of 0.001% to 0.005% B, 0.005% to 0.05% Nb, 0.005% to 0.05% Ti, 0.001% to 1.0% Cr, 0.05% to 1.0% Mo, 0.05% to 1.0% Cu, and 0.05% to 1.0% Ni. Among these elements, Cr, Mo, Nb, Cu, and/or Ni may be added for the purpose of not improving mechanical properties but achieving good adhesion of the coating because the use of Cr, Mo, Nb, Cu, and Ni alone or in combination has the effect of promote the internal oxidation of Si to suppress surface concentration.

Reasons for limiting the appropriate amounts of these elements are as described below.

B: 0.001% to 0.005%

When the content of B is less than 0.001%, the effect of promoting hardening is unlikely to be achieved. In contrast, when the content thereof is more than 0.005%, the adhesion of the coating is deteriorated. Thus, when B is contained, the content of B is 0.001% to 0.005%. However, B need not be added if the addition thereof is judged to be unnecessary to improve mechanical properties.

Nb: 0.005% to 0.05%

When the content of Nb is less than 0.005%, the effect of adjusting strength and the effect of improving the adhesion of the coating are unlikely to be achieved in the case of the addition of Mo. In contrast, when the content thereof is more than 0.05%, an increase in cost is caused. Thus, when Nb is contained, the content of Nb is 0.005% to 0.05%.

Ti: 0.005% to 0.05%

When the content of Ti is less than 0.005%, the effect of adjusting strength is unlikely to be achieved. In contrast, when the content thereof is more than 0.05%, the adhesion of the coating is deteriorated. Thus, when Ti is contained, the content of Ti is 0.005% to 0.05%.

Cr: 0.001% to 1.0%

When the content of Cr is less than 0.001%, the following effects are unlikely to be achieved: the effect of promoting hardening and the effect of promoting internal oxidation in the case where an annealing atmosphere contains a large amount of $H_2O$ and therefore is humid. In contrast, when the content thereof is more than 1.0%, the adhesion of the coating and weldability are deteriorated because of the surface concentration of Cr. Thus, when Cr is contained, the content of Cr is 0.001% to 1.0%.

Mo: 0.05% to 1.0%

When the content of Mo is less than 0.05%, the following effects are unlikely to be achieved: the effect of adjusting strength and the effect of improving the adhesion of the coating in the case of the addition of Nb, Ni, or Cu. In contrast, when the content thereof is more than 1.0%, an increase in cost is caused. Thus, when Mo is contained, the content of Mo is 0.05% to 1.0%.

Cu: 0.05% to 1.0%

When the content of Cu is less than 0.05%, the following effects are unlikely to be achieved: the effect of promoting the formation of a retained γ phase and the effect of improving the adhesion of the coating in the case of the addition of Ni and/or Mo. In contrast, when the content thereof is more than 1.0%, an increase in cost is caused. Thus, when Cu is contained, the content of Cu is 0.05% to 1.0%.

Ni: 0.05% to 1.0%

When the content of Ni is less than 0.05%, the following effects are unlikely to be achieved: the effect of promoting the formation of the retained γ phase and the effect of improving the adhesion of the coating in the case of the addition of Cu and/or Mo. In contrast, when the content thereof is more than 1.0%, an increase in cost is caused. Thus, when Ni is contained, the content of Ni is 0.05% to 1.0%.

The remainder other than the above is Fe and unavoidable impurities.

A method for manufacturing the high-strength galvanized steel sheet according to embodiments of the present invention and reasons for limiting the same are described below.

Steel containing the above chemical components is hot-rolled and is then cold-rolled. The cold-rolled steel sheet is annealed and galvanized in a continuous galvanizing line. In this operation, in embodiments of the present invention, the dew-point temperature of an atmosphere is controlled to −5° C. or higher in the temperature region with a furnace temperature of A° C. to B° C. ($600 \leq A \leq 780$ and $800 \leq B \leq 900$) in a heating process during annealing. This may be the most important requirement in the present invention. During annealing or in a galvanizing step, the dew-point temperature, that is, the partial pressure of oxygen in an atmosphere is controlled as described above, whereby the potential of oxygen is increased; Si, Mn, and the like, which are oxidizable elements, are internal oxidized just before plating; and the activity of Si and Mn in the surface layer of the base metal is reduced. The external oxidation of these elements is suppressed, resulting in improvements in platability and exfoliation resistance.

Hot Rolling

Hot rolling can be performed under ordinary conditions.

Pickling

After hot rolling, pickling is preferably performed. Black scales formed on a surface are removed in a pickling step and cold rolling is then performed. Pickling conditions are not particularly limited.

Cold Rolling

Cold rolling is preferably performed at a rolling reduction of 40% to 80%. When the rolling reduction is less than 40%, the crystallization temperature is reduced and therefore mechanical properties are likely to be deteriorated. In contrast, when the rolling reduction is more than 80%, rolling costs are not only increased because of a high-strength steel sheet but also plating properties are deteriorated in some cases because of an increase in surface concentration during annealing.

The cold-rolled steel sheet is annealed and is then galvanized.

In the annealing furnace, a heating step is performed in a heating zone located upstream such that the steel sheet is heated to a predetermined temperature and a soaking step is performed in a soaking zone located downstream such that the steel sheet is held at a predetermined temperature for a predetermined time.

Galvanizing is performed in such a manner that the dew-point temperature of an atmosphere is controlled to −5° C. or higher in the temperature region with a furnace temperature of A° C. to B° C. ($600 \leq A \leq 780$ and $800 \leq B \leq 900$) as described above. The dew-point temperature of an atmosphere in the annealing furnace other than a region from A° C. to B° C. is not particularly limited and is preferably within a range from −50° C. to −10° C.

When the concentration of hydrogen in the atmosphere in the annealing furnace is less than 1%, an activation effect due to reduction is not achieved and exfoliation resistance is deteriorated. The upper limit thereof is not particularly limited. When the concentration thereof is more than 50%, costs are increased and the effect is saturated. Thus, the concentration of hydrogen is preferably 1% to 50%. Gas components present in the annealing furnace are gaseous nitrogen and gaseous unavoidable impurities except gaseous hydrogen. Another gas component may be contained if effects of the present invention are not impaired.

Galvanizing can be performed by an ordinary process.

For comparison under the same annealing conditions, the surface concentration of Si and that of Mn increase in proportion to the content of Si and that of Mn, respectively, in steel. For the same type of steel, Si and Mn in steel are internally oxidized in a relatively high-oxygen potential atmosphere and therefore the surface concentration is reduced with an increase in the potential of oxygen in an atmosphere. Therefore, when the content of Si or Mn in steel is large, the potential of oxygen in an atmosphere needs to be increased by increasing the dew-point temperature.

Alloying is subsequently performed as required.

In the case of performing alloying subsequently to galvanizing, the galvanized steel sheet is preferably alloyed by heating the galvanized steel sheet to a temperature of 450° C. to 600° C. such that the content of Fe in the plating layer is 7% to 15%. When the content thereof is less than 7%, uneven alloying occurs and flaking properties are deteriorated. In contrast, when the content thereof is more than 15%, exfoliation resistance is deteriorated.

The high-strength galvanized steel sheet according to embodiments of the present invention is obtained as described above. The high-strength galvanized steel sheet according to embodiments of the present invention has a zinc plating layer with a mass per unit area of 20 g/m$^2$ to 120 g/m$^2$ on the steel sheet. When the mass per unit area thereof is less than 20 g/m$^2$, it is difficult to ensure corrosion resistance. In contrast, when the mass per unit area thereof is more than 120 g/m$^2$, exfoliation resistance is deteriorated.

The surface structure of the base steel sheet lying directly under the plating layer is characteristic as described below.

An oxide of at least one or more selected from the group consisting of Fe, Si, Mn, Al, P, B, Nb, Ti, Cr, Mo, Cu, and Ni is formed in a surface portion of the steel sheet that lies directly under the zinc plating layer and that is within 100 μm from a surface of the base steel sheet at 0.010 g/m$^2$ to 0.50 g/m$^2$ per unit area in total. Furthermore, a crystalline Si oxide, a crystalline Mn oxide, or a crystalline Si—Mn complex oxide is present in base metal grains that are present in a region within 10 μm from a surface of the base steel sheet directly under the plating layer and that are within 1 μm from grain boundaries.

In a galvanized steel sheet made from steel containing large amounts of Si and Mn, in order to satisfy exfoliation resistance during heavy machining, it is also necessary to highly control the microstructure and texture of a surface layer of a base metal lying directly under the plating layer which may crack during heavy machining. In order to increase the potential of oxygen in the annealing step for the purpose of ensuring platability, the dew-point temperature is controlled as described above. This results in that Si, Mn, and the like, which are oxidizable elements, are internal oxidized just before plating and therefore the activity of Si and Mn in the surface portion of the base metal is reduced. The external oxidation of these elements is suppressed, resulting in improvements in platability and exfoliation resistance. The improvement effect is due to the presence of 0.010 g/m$^2$ or more of the oxide of at least one or more selected from the group consisting of Fe, Si, Mn, Al, P, B, Nb, Ti, Cr, Mo, Cu, and Ni in the surface portion of the steel sheet that lies directly under the zinc plating layer and that is within 100 μm from a surface of the base steel sheet. However, even if more than 0.50 g/m$^2$ of the oxide thereof is present, this effect is saturated. Therefore, the upper limit thereof is 0.50 g/m$^2$.

When the internal oxide is present at grain boundaries and is not present in grains, the grain boundary diffusion of an oxidizable element in steel can be suppressed but the intragranular diffusion thereof cannot be sufficiently suppressed in some cases. Therefore, internal oxidation is caused not only at grain boundaries but also in grains in such a manner that the dew-point temperature of an atmosphere is controlled to −5° C. or higher in the temperature region with a furnace temperature of A° C. to B° C. (600≤A≤780 and 800≤B≤900) as described above. In particular, the crystalline Si oxide, the crystalline Mn oxide, or the crystalline Si—Mn complex oxide is allowed to be present in base metal grains that are present in a region within 10 μm down from the plating layer and that are within 1 μm from grain boundaries. The presence of the oxide in the base metal grains reduces the amounts of solute Si and Mn in the base metal grains near the oxide. As a result, the surface concentration of Si and Mn due to intragranular diffusion can be suppressed.

The surface structure of the base steel sheet directly under the plating layer of the high-strength galvanized steel sheet obtained by the manufacturing method according to embodiments of the present invention is as described above. There is no problem even if the oxide is grown in a region more than 100 μm down from the plating layer (the plating/base metal interface). Furthermore, there is no problem even if the crystalline Si oxide, the crystalline Mn oxide, or the crystalline Si—Mn complex oxide is present in base metal grains that are present in a region more than 10 μm apart from a surface of the base steel sheet directly under the plating layer and that are 1 μm or more apart from grain boundaries.

In addition, in embodiments of the present invention, in order to increase exfoliation resistance, the texture of a base metal in which the Si—Mn complex oxide is grown is preferably a ferrite phase which is soft and good in workability.

The present invention is described below in detail with reference to examples.

EXAMPLE 1

After hot-rolled steel sheets with steel compositions shown in Table 1 were pickled and black scales were thereby removed therefrom, the hot-rolled steel sheets were cold-rolled under conditions shown in Table 2, whereby cold-rolled steel sheets with a thickness of 1.0 mm were obtained.

TABLE 1

(% by mass)

| Symbol | C | Si | Mn | Al | P | S | Cr | Mo | B | Nb | Cu | Ni | Ti |
|---|---|---|---|---|---|---|---|---|---|---|---|---|---|
| A | 0.05 | 0.03 | 2.0 | 0.03 | 0.01 | 0.004 | — | — | — | — | — | — | — |
| C | 0.15 | 0.10 | 2.1 | 0.03 | 0.01 | 0.004 | — | — | — | — | — | — | — |
| D | 0.05 | 0.25 | 2.0 | 0.03 | 0.01 | 0.004 | — | — | — | — | — | — | — |
| E | 0.05 | 0.39 | 2.1 | 0.03 | 0.01 | 0.004 | — | — | — | — | — | — | — |
| F | 0.05 | 0.10 | 2.9 | 0.03 | 0.01 | 0.004 | — | — | — | — | — | — | — |
| G | 0.05 | 0.10 | 2.0 | 0.90 | 0.01 | 0.004 | — | — | — | — | — | — | — |
| H | 0.05 | 0.10 | 2.1 | 0.03 | 0.05 | 0.004 | — | — | — | — | — | — | — |
| I | 0.05 | 0.10 | 1.9 | 0.03 | 0.01 | 0.009 | — | — | — | — | — | — | — |
| J | 0.05 | 0.10 | 1.9 | 0.02 | 0.01 | 0.004 | 0.8 | — | — | — | — | — | — |
| K | 0.05 | 0.10 | 1.9 | 0.03 | 0.01 | 0.004 | — | 0.1 | — | — | — | — | — |
| L | 0.05 | 0.10 | 2.2 | 0.03 | 0.01 | 0.004 | — | — | 0.003 | — | — | — | — |
| M | 0.05 | 0.10 | 2.0 | 0.05 | 0.01 | 0.004 | — | — | 0.001 | 0.03 | — | — | — |
| N | 0.05 | 0.10 | 1.9 | 0.03 | 0.01 | 0.004 | — | 0.1 | — | — | 0.1 | 0.2 | — |
| O | 0.05 | 0.10 | 1.9 | 0.04 | 0.01 | 0.004 | — | — | 0.001 | — | — | — | 0.02 |
| P | 0.05 | 0.10 | 1.9 | 0.03 | 0.01 | 0.004 | — | — | — | — | — | — | 0.05 |
| Q | 0.16 | 0.10 | 2.2 | 0.03 | 0.01 | 0.004 | — | — | — | — | — | — | — |
| S | 0.02 | 0.10 | 3.1 | 0.03 | 0.01 | 0.004 | — | — | — | — | — | — | — |
| T | 0.02 | 0.10 | 1.9 | 1.10 | 0.01 | 0.004 | — | — | — | — | — | — | — |
| U | 0.02 | 0.10 | 1.9 | 0.03 | 0.07 | 0.004 | — | — | — | — | — | — | — |
| V | 0.02 | 0.10 | 1.9 | 0.03 | 0.01 | 0.020 | — | — | — | — | — | — | — |

The cold-rolled steel sheets obtained as described above were load into a CGL equipped with an annealing furnace that was an all-radiant tube-type furnace. In the CGL, as shown in Table 2, each sheet was fed through a predetermined temperature region in the furnace with the dew-point temperature of the predetermined temperature region being controlled, was heated in a heating zone, was soaked in a soaking zone, was annealed, and was then galvanized in an Al-containing Zn bath at 460° C. The dew-point temperature of an annealing furnace atmosphere other than the region of which the dew-point temperature was controlled as described above was basically −35° C.

Gas components of the atmosphere were gaseous nitrogen, gaseous hydrogen, and gaseous unavoidable impurities. The dew-point temperature of the atmosphere was controlled in such a manner that a pipe was laid in advance such that a humidified nitrogen gas prepared by heating a water tank placed in a nitrogen gas flowed through the pipe, a hydrogen gas was introduced into the humidified nitrogen gas and was mixed therewith, and the mixture was introduced into the furnace. The concentration of hydrogen in the atmosphere was basically 10% by volume.

GAs used a 0.14% Al-containing Zn bath and GIs used a 0.18% Al-containing Zn bath. The mass (mass per unit area) was adjusted to 40 g/m$^2$, 70 g/m$^2$, or 140 g/m$^2$ by gas wiping and the GAs were alloyed.

Galvanized steel sheets (GAs and GIs) obtained as described above were checked for appearance (coating appearance), exfoliation resistance during heavy machining, and workability. Also measured were the amount (internal oxidation) of an oxide present in a surface portion of each base steel sheet within 100 μm down from a plating layer, the morphology and growth points of an Si—Mn composite oxide present in a surface layer of the base steel sheet within 10 μm down from the plating layer, and intragranular precipitates, located within 1 μm from grain boundaries, directly under the plating layer. Measurement methods and evaluation standards were as described below.

(Appearance)

For appearance, those having no appearance failure including non-plating and uneven alloying were judged to be good in appearance (symbol A) and those having appearance failure were judged to be poor in appearance (symbol B).

(Exfoliation Resistance)

For exfoliation resistance during heavy machining, the exfoliation of a bent portion needs to be suppressed when a GA is bent at an acute angle of less than 90 degrees. In this example, exfoliated pieces were transferred to a cellophane tape by pressing the cellophane tape against a 120 degree bent portion and the amount of the exfoliated pieces on the cellophane tape was determined from the number of Zn counts by X-ray fluorescence spectrometry. The diameter of a mask used herein was 30 mm, the accelerating voltage of fluorescent X-ray was 50 kV, the accelerating current was 50 mA, and the time of measurement was 20 seconds. In the light of standards below, those ranked 1 or 2 were evaluated to be good in exfoliation resistance (symbol A) and those ranked 3 or higher were evaluated to be poor in exfoliation resistance (symbol B).

Number of X-ray fluorescence Zn counts: rank 0 to less than 500: 1 (good)

500 to less than 1000: 2

1000 to less than 2000: 3

2000 to less than 3000: 4

3000 or more: 5 (poor)

GIs need to have exfoliation resistance as determined by an impact test. Whether a plating layer was exfoliated was visually judged in such a manner that a ball impact test was performed and a tape was removed from a machined portion. Ball impact conditions were a ball weight of 1000 g and a drop height of 100 cm.

A: No plating layer was exfoliated.

B: A plating layer was exfoliated.

(Workability)

For workability, JIS #5 specimens were prepared and measured for tensile strength (TS/MPa) and elongation (El %). In the case where TS was less than 650 MPa, those satisfying TS×El≥22000 were judged to be good and those satisfying TS×El<22000 were judged to be poor. In the case where TS was 650 MPa to less than 900 MPa, those satisfying TS×El≥20000 were judged to be good and those satisfying TS×El<20000 were judged to be poor. In the case where TS was 900 MPa or more, those satisfying TS×El≥18000 were judged to be good and those satisfying TS×El<18000 were judged to be poor.

(Internal Oxidation of Region within 100 μm Down from Plating Layer)

The internal oxidation was measured by "impulse furnace fusion/infrared absorption spectrometry". The amount of oxygen contained in a base material (that is, an unannealed high-strength steel sheet) needs to be subtracted; hence both surface portions of a continuously annealed high-strength steel sheet were polished by 100 μm or more and were measured for oxygen concentration and the measurements were converted into the amount OH of oxygen contained in the base material. Furthermore, the continuously annealed high-strength steel sheet was measured for oxygen concentration in the thickness direction thereof and the measurement was converted into the amount OI of oxygen contained in the internally oxidized high-strength steel sheet. The difference (=OI−OH) between OI and OH was calculated using the amount OI of oxygen contained in the internally oxidized high-strength steel sheet and the amount OH of oxygen contained in the base material and a value ($g/m^2$) obtained by converting the difference into an amount per unit area (that is, 1 $m^2$) was used as the internal oxidation.

(Growth Points of Si—Mn Composite Oxide Present in Steel Sheet Surface Portion in Region within 10 μm Down from Plating Layer and Intragranular Precipitates, Located within 1 μm from Grain Boundaries, Directly Under Plating Layer)

After a plating layer was dissolved off, a cross section thereof was observed by SEM, whether the intragranular precipitates were amorphous or crystalline was examined by electron beam diffraction, and the composition was determined by EDX and EELS. When the intragranular precipitates were crystalline and Si and Mn were major components thereof, the intragranular precipitates were judged to be an Si—Mn composite oxide. Five fields of view were checked at 5000- to 20000-fold magnification. When the Si—Mn composite oxide was observed in one or more the five fields of view, the Si—Mn composite oxide was judged to be precipitated. Whether growth points of internal oxidation were ferrite was examined by checking the presence of a secondary phase by cross-sectional SEM. When no secondary phase was observed, the growth points were judged to be ferrite. For the crystalline Si—Mn complex oxide in base metal grains that were present in a region within 10 μm down from the plating layer and that were within 1 μm from grain boundaries, a precipitated oxide was extracted from a cross section by an extraction replica method and was determined by a technique similar to the above.

Results obtained as described above are shown in Table 2 together with manufacturing conditions.

TABLE 2

| | Steel | | | Manufacturing method | | | | | | Internal oxidation of region within 100 μm down from plating layer ($g/m^2$) | Internal oxide in region within 10 μm down from plating layer | |
|---|---|---|---|---|---|---|---|---|---|---|---|---|
| | | | | | Heating zone | | | Soaking zone | | | | |
| No. | No | Si (% by mass) | Mn (% by mass) | Cold rolling reduction (%) | Temperature A (° C.) | Temperature B (° C.) | Dew-point temperature (° C.) | Temperature (° C.) | Alloying temperature (° C.) | | Presence | Presence of oxide in grains, located within 1 μm from grain boundary, directly under plating layer |
| 1 | A | 0.03 | 2.0 | 50 | 600 | 790 | −5 | 800 | 500 | 0.009 | Not present | Not present |
| 2 | A | 0.03 | 2.0 | 50 | 600 | 800 | −5 | 800 | 500 | 0.010 | Present | Present |
| 3 | A | 0.03 | 2.0 | 50 | 600 | 800 | −5 | 800 | 500 | 0.010 | Present | Present |
| 4 | A | 0.03 | 2.0 | 50 | 600 | 850 | −5 | 850 | 500 | 0.030 | Present | Present |
| 5 | A | 0.03 | 2.0 | 50 | 650 | 850 | −5 | 850 | 500 | 0.030 | Present | Present |

TABLE 2-continued

| | | | | | | | | | | | | |
|---|---|---|---|---|---|---|---|---|---|---|---|---|
| 6 | A | 0.03 | 2.0 | 50 | 700 | 850 | −5 | 850 | 500 | 0.030 | Present | Present |
| 7 | A | 0.03 | 2.0 | 50 | 750 | 850 | −5 | 850 | 500 | 0.030 | Present | Present |
| 8 | A | 0.03 | 2.0 | 50 | 780 | 850 | −5 | 850 | 500 | 0.040 | Present | Present |
| 9 | A | 0.03 | 2.0 | 50 | 790 | 850 | −5 | 850 | 500 | 0.060 | Present | Present |
| 10 | A | 0.03 | 2.0 | 50 | 600 | 900 | −5 | 900 | 500 | 0.490 | Present | Present |
| 11 | A | 0.03 | 2.0 | 50 | 600 | 910 | −5 | 910 | 500 | 0.510 | Present | Present |
| 12 | A | 0.03 | 2.0 | 50 | 600 | 850 | −35 | 850 | 500 | 0.030 | Not present | Not present |
| 13 | A | 0.03 | 2.0 | 50 | 600 | 850 | −20 | 850 | 500 | 0.030 | Present | Not present |
| 14 | A | 0.03 | 2.0 | 50 | 600 | 850 | −6 | 850 | 500 | 0.009 | Present | Present |
| 15 | A | 0.03 | 2.0 | 50 | 600 | 850 | 0 | 850 | 500 | 0.030 | Present | Present |
| 16 | A | 0.03 | 2.0 | 50 | 600 | 850 | 20 | 850 | 500 | 0.290 | Present | Present |
| 17 | A | 0.03 | 2.0 | 50 | 600 | 850 | 60 | 850 | 500 | 0.410 | Present | Present |
| 18 | A | 0.03 | 2.0 | 50 | 600 | 850 | −5 | 850 | Not alloyed | 0.030 | Present | Present |
| 19 | A | 0.03 | 2.0 | 50 | 600 | 850 | −5 | 850 | 500 | 0.030 | Present | Present |
| 20 | A | 0.03 | 2.0 | 50 | 600 | 850 | −5 | 850 | 460 | 0.030 | Present | Present |
| 21 | A | 0.03 | 2.0 | 50 | 600 | 850 | −5 | 850 | 550 | 0.030 | Present | Present |
| 22 | A | 0.03 | 2.0 | 50 | 600 | 850 | −5 | 850 | 600 | 0.030 | Present | Present |
| 23 | C | 0.10 | 2.1 | 50 | 600 | 850 | −5 | 850 | 500 | 0.040 | Present | Present |
| 24 | D | 0.25 | 2.0 | 50 | 600 | 850 | −5 | 850 | 500 | 0.050 | Present | Present |
| 25 | E | 0.39 | 2.1 | 50 | 600 | 850 | −5 | 850 | 500 | 0.090 | Present | Present |
| 26 | F | 0.10 | 2.9 | 50 | 600 | 850 | −5 | 850 | 500 | 0.030 | Present | Present |
| 27 | G | 0.10 | 2.0 | 50 | 600 | 850 | −5 | 850 | 500 | 0.080 | Present | Present |
| 28 | H | 0.10 | 2.1 | 50 | 600 | 850 | −5 | 850 | 500 | 0.050 | Present | Present |
| 29 | I | 0.10 | 1.9 | 50 | 600 | 850 | −5 | 850 | 500 | 0.040 | Present | Present |
| 30 | J | 0.10 | 1.9 | 50 | 600 | 850 | −5 | 850 | 500 | 0.040 | Present | Present |
| 31 | K | 0.10 | 1.9 | 50 | 600 | 850 | −5 | 850 | 500 | 0.030 | Present | Present |
| 32 | L | 0.10 | 2.2 | 50 | 600 | 850 | −5 | 850 | 500 | 0.030 | Present | Present |
| 33 | M | 0.10 | 2.0 | 50 | 600 | 850 | −5 | 850 | 500 | 0.040 | Present | Present |
| 34 | N | 0.10 | 1.9 | 50 | 600 | 850 | −5 | 850 | 500 | 0.040 | Present | Present |
| 35 | O | 0.10 | 1.9 | 50 | 600 | 850 | −5 | 850 | 500 | 0.040 | Present | Present |
| 36 | P | 0.10 | 1.9 | 50 | 600 | 850 | −5 | 850 | 500 | 0.040 | Present | Present |
| 37 | Q | 0.10 | 2.2 | 50 | 600 | 850 | −5 | 850 | 500 | 0.030 | Present | Present |
| 38 | S | 0.10 | 3.1 | 50 | 600 | 850 | −5 | 850 | 500 | 0.050 | Present | Present |
| 39 | T | 0.10 | 1.9 | 50 | 600 | 850 | −5 | 850 | 500 | 0.030 | Present | Present |
| 40 | U | 0.10 | 1.9 | 50 | 600 | 850 | −5 | 850 | 500 | 0.030 | Present | Present |
| 41 | V | 0.10 | 1.9 | 50 | 600 | 850 | −5 | 850 | 500 | 0.030 | Present | Present |

| No. | Mass per unit area ($g/m^2$) | Plating type | Content of Fe in plating layer (% by mass) | Coating appearance | Exfoliation resistance | TS (MPa) | EI (%) | TS × EI | Workability | Classification |
|---|---|---|---|---|---|---|---|---|---|---|
| 1 | 40 | GA | 10 | B | A | 630 | 38.9 | 24507 | Good | Comparative example |
| 2 | 40 | GA | 10 | A | A | 645 | 37.4 | 24123 | Good | Inventive example |
| 3 | 40 | GA | 10 | A | A | 629 | 36.5 | 22959 | Good | Inventive example |
| 4 | 40 | GA | 10 | A | A | 669 | 37.4 | 25021 | Good | Inventive example |
| 5 | 40 | GA | 10 | A | A | 663 | 36.8 | 24398 | Good | Inventive example |
| 6 | 40 | GA | 10 | A | A | 664 | 37.1 | 24634 | Good | Inventive example |
| 7 | 40 | GA | 10 | A | A | 669 | 36.5 | 24419 | Good | Inventive example |
| 8 | 40 | GA | 10 | A | A | 672 | 35.9 | 24125 | Good | Inventive example |
| 9 | 40 | GA | 10 | B | A | 671 | 37.3 | 25028 | Good | Comparative example |
| 10 | 40 | GA | 10 | A | A | 711 | 34.1 | 24245 | Good | Inventive example |
| 11 | 40 | GA | 10 | A | A | 733 | 26.1 | 19131 | Not good | Comparative example |
| 12 | 40 | GA | 10 | B | A | 674 | 35.4 | 23860 | Good | Comparative example |
| 13 | 40 | GA | 10 | B | A | 668 | 36.4 | 24315 | Good | Comparative example |
| 14 | 40 | GA | 10 | B | A | 664 | 39.1 | 25962 | Good | Comparative example |
| 15 | 40 | GA | 10 | A | A | 669 | 35.7 | 23883 | Good | Inventive example |
| 16 | 40 | GA | 10 | A | A | 672 | 38.1 | 25603 | Good | Inventive example |
| 17 | 40 | GA | 10 | A | A | 670 | 36.9 | 24723 | Good | Inventive example |
| 18 | 40 | GI | 1 | A | A | 661 | 36.5 | 24127 | Good | Inventive example |
| 19 | 130 | GA | 10 | A | B | 666 | 34.3 | 22844 | Good | Comparative example |
| 20 | 40 | GA | 7 | A | A | 668 | 38.1 | 25451 | Good | Inventive example |
| 21 | 40 | GA | 12 | A | A | 672 | 37.4 | 25133 | Good | Inventive example |
| 22 | 40 | GA | 15 | A | A | 671 | 36.9 | 24760 | Good | Inventive example |
| 23 | 40 | GA | 10 | A | A | 793 | 28.9 | 22918 | Good | Inventive example |
| 24 | 40 | GA | 10 | A | A | 660 | 42.5 | 28050 | Good | Inventive example |
| 25 | 40 | GA | 10 | A | A | 671 | 44.6 | 29927 | Good | Inventive example |
| 26 | 40 | GA | 10 | A | A | 698 | 33.5 | 23383 | Good | Inventive example |
| 27 | 40 | GA | 10 | A | A | 665 | 34.3 | 22810 | Good | Inventive example |
| 28 | 40 | GA | 10 | A | A | 805 | 28.2 | 22701 | Good | Inventive example |
| 29 | 40 | GA | 10 | A | A | 659 | 35.9 | 23658 | Good | Inventive example |

TABLE 2-continued

| | | | | | | | | | | |
|---|---|---|---|---|---|---|---|---|---|---|
| 30 | 40 | GA | 10 | A | A | 663 | 34.9 | 23139 | Good | Inventive example |
| 31 | 40 | GA | 10 | A | A | 691 | 33.4 | 23079 | Good | Inventive example |
| 32 | 40 | GA | 10 | A | A | 689 | 33.3 | 22944 | Good | Inventive example |
| 33 | 40 | GA | 10 | A | A | 694 | 32.1 | 22277 | Good | Inventive example |
| 34 | 40 | GA | 10 | A | A | 685 | 33.6 | 23016 | Good | Inventive example |
| 35 | 40 | GA | 10 | A | A | 667 | 34.6 | 23078 | Good | Inventive example |
| 36 | 40 | GA | 10 | A | A | 665 | 35.2 | 23408 | Good | Inventive example |
| 37 | 40 | GA | 10 | A | A | 812 | 25.9 | 21031 | Good | Inventive example |
| 38 | 40 | GA | 10 | B | B | 709 | 33.2 | 23539 | Good | Comparative example |
| 39 | 40 | GA | 10 | B | A | 693 | 35.5 | 24602 | Good | Comparative example |
| 40 | 40 | GA | 10 | B | B | 886 | 21.5 | 19049 | Not good | Comparative example |
| 41 | 40 | GA | 10 | A | A | 664 | 23.1 | 15338 | Not good | Comparative example |

As is clear from Table 2, GIs and GAs (inventive examples) manufactured by a method according to aspects of the present invention are high-strength steel sheets containing large amounts of oxidizable elements such as Si and Mn and, however, have excellent workability, excellent exfoliation resistance during heavy machining, and good coating appearance.

In comparative examples, one or more of coating appearance, workability, and exfoliation resistance during heavy machining are poor.

EXAMPLE 2

After hot-rolled steel sheets with steel compositions shown in Table 3 were pickled and black scales were thereby removed therefrom, the hot-rolled steel sheets were cold-rolled under conditions shown in Table 4, whereby cold-rolled steel sheets with a thickness of 1.0 mm were obtained.

TABLE 3

(% by mass)

| Steel symbol | C | Si | Mn | Al | P | S | Cr | Mo | B | Nb | Cu | Ni | Ti |
|---|---|---|---|---|---|---|---|---|---|---|---|---|---|
| AA | 0.12 | 0.8 | 1.9 | 0.03 | 0.01 | 0.004 | — | — | — | — | — | — | — |
| AB | 0.02 | 0.4 | 1.9 | 0.04 | 0.01 | 0.003 | — | — | — | — | — | — | — |
| AC | 0.17 | 1.2 | 1.9 | 0.03 | 0.01 | 0.004 | — | — | — | — | — | — | — |
| AD | 0.10 | 1.6 | 2.0 | 0.04 | 0.01 | 0.003 | — | — | — | — | — | — | — |
| AE | 0.05 | 2.0 | 2.1 | 0.04 | 0.01 | 0.003 | — | — | — | — | — | — | — |
| AF | 0.12 | 0.8 | 2.9 | 0.04 | 0.01 | 0.004 | — | — | — | — | — | — | — |
| AG | 0.12 | 0.8 | 1.9 | 0.90 | 0.01 | 0.004 | — | — | — | — | — | — | — |
| AH | 0.12 | 0.8 | 2.1 | 0.04 | 0.05 | 0.003 | — | — | — | — | — | — | — |
| AI | 0.12 | 0.8 | 2.1 | 0.03 | 0.01 | 0.009 | — | — | — | — | — | — | — |
| AJ | 0.12 | 0.8 | 2.1 | 0.02 | 0.01 | 0.003 | 0.6 | — | — | — | — | — | — |
| AK | 0.12 | 0.8 | 1.9 | 0.04 | 0.01 | 0.004 | — | 0.1 | — | — | — | — | — |
| AL | 0.12 | 0.8 | 2.2 | 0.03 | 0.01 | 0.004 | — | — | 0.004 | — | — | — | — |
| AM | 0.12 | 0.8 | 2.0 | 0.05 | 0.01 | 0.004 | — | — | 0.001 | 0.03 | — | — | — |
| AN | 0.12 | 0.8 | 2.1 | 0.03 | 0.01 | 0.003 | — | 0.1 | — | — | 0.1 | 0.2 | — |
| AO | 0.12 | 0.8 | 2.1 | 0.04 | 0.01 | 0.003 | — | — | 0.002 | — | — | — | 0.02 |
| AP | 0.12 | 0.8 | 1.9 | 0.03 | 0.01 | 0.003 | — | — | — | — | — | — | 0.04 |
| AQ | 0.20 | 0.8 | 2.2 | 0.04 | 0.01 | 0.003 | — | — | — | — | — | — | — |
| AR | 0.12 | 2.1 | 2.0 | 0.04 | 0.01 | 0.004 | — | — | — | — | — | — | — |
| AS | 0.12 | 0.8 | 3.1 | 0.04 | 0.01 | 0.004 | — | — | — | — | — | — | — |
| AT | 0.12 | 0.8 | 2.1 | 1.10 | 0.01 | 0.003 | — | — | — | — | — | — | — |
| AU | 0.12 | 0.8 | 2.1 | 0.03 | 0.07 | 0.003 | — | — | — | — | — | — | — |
| AV | 0.12 | 0.8 | 2.1 | 0.04 | 0.01 | 0.020 | — | — | — | — | — | — | — |

The cold-rolled steel sheets obtained as described above were load into a CGL equipped with an annealing furnace that was an all-radiant tube-type furnace. In the CGL, as shown in Table 4, each sheet was fed through a predetermined temperature region in the furnace with the dew-point temperature of the predetermined temperature region being controlled, was heated in a heating zone, was soaked in a soaking zone, was annealed, and was then galvanized in an Al-containing Zn bath at 460° C. The dew-point temperature of an annealing furnace atmosphere other than the region of which the dew-point temperature was controlled as described above was basically −35° C.

Gas components of the atmosphere were gaseous nitrogen, gaseous hydrogen, and gaseous unavoidable impurities. The dew-point temperature of the atmosphere was controlled in such a manner that a pipe was laid in advance such that a humidified nitrogen gas prepared by heating a water tank placed in a nitrogen gas flowed through the pipe, a hydrogen gas was introduced into the humidified nitrogen gas and was mixed therewith, and the mixture was introduced into the furnace. The concentration of hydrogen in the atmosphere was basically 10% by volume.

GAs used a 0.14% Al-containing Zn bath and GIs used a 0.18% Al-containing Zn bath. The mass (mass per unit area) was adjusted to 40 g/m$^2$, 70 g/m$^2$, or 140 g/m$^2$ by gas wiping and the GAs were alloyed.

Galvanized steel sheets (GAs and GIs) obtained as described above were checked for appearance (coating appearance), exfoliation resistance during heavy machining, and workability. Also measured were the amount (internal oxidation) of an oxide present in a surface portion of each base steel sheet within 100 μm down from a plating layer, the morphology and growth points of an Si—Mn composite oxide present in a surface layer of the base steel sheet within 10 μm down from the plating layer, and intragranular precipitates, located within 1 μm from grain boundaries, directly under the plating layer. Measurement methods and evaluation standards were as described below.

(Appearance)

For appearance, those having no appearance failure including non-plating and uneven alloying were judged to be good in appearance (symbol A) and those having appearance failure were judged to be poor in appearance (symbol B).

(Exfoliation Resistance During Heavy Machining)

For exfoliation resistance during heavy machining, the exfoliation of a bent portion needs to be suppressed when a GA is bent at an acute angle of less than 90 degrees. In this example, exfoliated pieces were transferred to a cellophane tape by pressing the cellophane tape against a 120 degree bent portion and the amount of the exfoliated pieces on the cellophane tape was determined from the number of Zn counts by X-ray fluorescence spectrometry. The diameter of a mask used herein was 30 mm, the accelerating voltage of fluorescent X-ray was 50 kV, the accelerating current was 50 mA, and the time of measurement was 20 seconds. Evaluation was performed in the light of standards below. Symbols A and B indicate that performance has no problem with exfoliation resistance during heavy machining. Symbol C indicates that performance can be suitable for practical use depending on the degree of machining. Symbols D and E indicate that performance are not suitable for practical use.

Number of X-ray fluorescence Zn counts: rank 0 to less than 500: 1 (good), A 500 to less than 1000: 2, B 1000 to less than 2000: 3, C 2000 to less than 3000: 4, D 3000 or more: 5 (poor), E GIs need to have exfoliation resistance as determined by an impact test. Whether a plating layer was exfoliated was visually judged in such a manner that a ball impact test was performed and a tape was removed from a machined portion. Ball impact conditions were a ball weight of 1000 g and a drop height of 100 cm.

A: No plating layer was exfoliated.

B: A plating layer was exfoliated.

(Workability)

For workability, JIS #5 specimens were prepared and measured for tensile strength (TS/MPa) and elongation (El %). In the case where TS was less than 650 MPa, those satisfying TS×El≥22000 were judged to be good and those satisfying TS×El<22000 were judged to be poor. In the case where TS was 650 MPa to less than 900 MPa, those satisfying TS×El≥20000 were judged to be good and those satisfying TS×El<20000 were judged to be poor. In the case where TS was 900 MPa or more, those satisfying TS×El≥18000 were judged to be good and those satisfying TS×El<18000 were judged to be poor.

(Internal Oxidation of Region within 100 μm Down from Plating Layer)

The internal oxidation was measured by "impulse furnace fusion/infrared absorption spectrometry". The amount of oxygen contained in a base material (that is, an unannealed high-strength steel sheet) needs to be subtracted; hence, both surface portions of a continuously annealed high-strength steel sheet were polished by 100 μm or more and were measured for oxygen concentration and the measurements were converted into the amount OH of oxygen contained in the base material. Furthermore, the continuously annealed high-strength steel sheet was measured for oxygen concentration in the thickness direction thereof and the measurement was converted into the amount OI of oxygen contained in the internally oxidized high-strength steel sheet. The difference (=OI−OH) between OI and OH was calculated using the amount OI of oxygen contained in the internally oxidized high-strength steel sheet and the amount OH of oxygen contained in the base material and a value ($g/m^2$) obtained by converting the difference into an amount per unit area (that is, 1 $m^2$) was used as the internal oxidation.

(Growth Points of Si—Mn Composite Oxide Present in Steel Sheet Surface Portion in Region within 10 μm Down from Plating Layer and Intragranular Precipitates, Located within 1 μm from Grain Boundaries, Directly Under Plating Layer)

After a plating layer was dissolved off, a cross section thereof was observed by SEM, whether the intragranular precipitates were amorphous or crystalline was examined by electron beam diffraction, and the composition was determined by EDX and EELS. When the intragranular precipitates were crystalline and Si and Mn were major components thereof, the intragranular precipitates were judged to be an Si—Mn composite oxide. Five fields of view were checked at 5000- to 20000-fold magnification. When the Si—Mn composite oxide was observed in one or more the five fields of view, the Si—Mn composite oxide was judged to be precipitated. Whether growth points of internal oxidation were ferrite was examined by checking the presence of a secondary phase by cross-sectional SEM. When no secondary phase was observed, the growth points were judged to be ferrite. For the crystalline Si—Mn complex oxide in base metal grains that were present in a region within 10 μm down from the plating layer and that were within 1 μm from grain boundaries, a precipitated oxide was extracted from a cross section by an extraction replica method and was determined by a technique similar to the above.

Results obtained as described above are shown in Table 4 together with manufacturing conditions.

TABLE 4

| | Steel | | | Manufacturing method | | | | | | Internal oxidation | Internal oxide in region within 10 μm down from plating layer | |
|---|---|---|---|---|---|---|---|---|---|---|---|---|
| | | | | | Heating zone | | | Soaking | Alloy- | of region within | | Presence of oxide in grains, |
| | | | | Cold | Temper- | Temper- | Dew-point | zone | ing | 100 μm | | located within |
| | | | | rolling | ature | ature | temper- | Temper- | temper- | down from | | 1 μm from grain |
| No. | No | Si (% by mass) | Mn (% by mass) | reduction (%) | A (° C.) | B (° C.) | ature (° C.) | ature (° C.) | ature (° C.) | plating layer ($g/m^2$) | Presence | boundary, directly under plating layer |
| 42 | AA | 0.8 | 1.9 | 50 | 600 | 700 | −5 | 800 | 500 | 0.005 | Not present | Not present |
| 43 | AA | 0.8 | 1.9 | 50 | 600 | 790 | −5 | 800 | 500 | 0.009 | Not present | Not present |

TABLE 4-continued

| | | | | | | | | | | | | |
|---|---|---|---|---|---|---|---|---|---|---|---|---|
| 44 | AA | 0.8 | 1.9 | 50 | 600 | 800 | −5 | 800 | 500 | 0.015 | Present | Present |
| 45 | AA | 0.8 | 1.9 | 50 | 600 | 850 | −5 | 850 | 500 | 0.019 | Present | Present |
| 46 | AA | 0.8 | 1.9 | 50 | 650 | 850 | −5 | 850 | 500 | 0.021 | Present | Present |
| 47 | AA | 0.8 | 1.9 | 50 | 700 | 850 | −5 | 850 | 500 | 0.018 | Present | Present |
| 48 | AA | 0.8 | 1.9 | 50 | 750 | 850 | −5 | 850 | 500 | 0.017 | Present | Present |
| 49 | AA | 0.8 | 1.9 | 50 | 780 | 850 | −5 | 850 | 500 | 0.015 | Present | Present |
| 50 | AA | 0.8 | 1.9 | 50 | 790 | 850 | −5 | 850 | 500 | 0.021 | Present | Present |
| 51 | AA | 0.8 | 1.9 | 50 | 600 | 900 | −5 | 900 | 500 | 0.495 | Present | Present |
| 52 | AA | 0.8 | 1.9 | 50 | 600 | 910 | −5 | 910 | 500 | 0.506 | Present | Present |
| 53 | AA | 0.8 | 1.9 | 50 | 600 | 850 | −35 | 850 | 500 | 0.005 | Not present | Not present |
| 54 | AA | 0.8 | 1.9 | 50 | 600 | 850 | −15 | 850 | 500 | 0.008 | Present | Not present |
| 55 | AA | 0.8 | 1.9 | 50 | 600 | 850 | −10 | 850 | 500 | 0.009 | Present | Not present |
| 56 | AA | 0.8 | 1.9 | 50 | 600 | 850 | 0 | 850 | 500 | 0.044 | Present | Present |
| 57 | AA | 0.8 | 1.9 | 50 | 600 | 850 | 20 | 850 | 500 | 0.276 | Present | Present |
| 58 | AA | 0.8 | 1.9 | 50 | 600 | 850 | 60 | 850 | 500 | 0.358 | Present | Present |
| 59 | AA | 0.8 | 1.9 | 50 | 600 | 850 | −5 | 850 | Not alloyed | 0.021 | Present | Present |
| 60 | AA | 0.8 | 1.9 | 50 | 750 | 850 | −5 | 850 | Not alloyed | 0.018 | Present | Present |
| 61 | AA | 0.8 | 1.9 | 50 | 600 | 900 | −5 | 850 | Not alloyed | 0.492 | Present | Present |
| 62 | AA | 0.8 | 1.9 | 50 | 600 | 850 | −10 | 850 | Not alloyed | 0.009 | Present | Not present |
| 63 | AA | 0.8 | 1.9 | 50 | 600 | 850 | 0 | 850 | Not alloyed | 0.049 | Present | Present |
| 64 | AA | 0.8 | 1.9 | 50 | 600 | 850 | −5 | 900 | Not alloyed | 0.026 | Present | Present |
| 65 | AA | 0.8 | 1.9 | 50 | 600 | 850 | −5 | 850 | 500 | 0.025 | Present | Present |
| 66 | AA | 0.8 | 1.9 | 50 | 600 | 850 | −5 | 850 | 460 | 0.024 | Present | Present |
| 67 | AA | 0.8 | 1.9 | 50 | 600 | 850 | −5 | 850 | 550 | 0.019 | Present | Present |
| 68 | AA | 0.8 | 1.9 | 50 | 600 | 850 | −5 | 850 | 600 | 0.022 | Present | Present |
| 69 | AB | 0.4 | 1.9 | 50 | 600 | 850 | −5 | 850 | 500 | 0.015 | Present | Present |
| 70 | AC | 1.2 | 1.9 | 50 | 600 | 850 | −5 | 850 | 500 | 0.033 | Present | Present |
| 71 | AD | 1.6 | 2.0 | 50 | 600 | 850 | −5 | 850 | 500 | 0.035 | Present | Present |
| 72 | AE | 2.0 | 2.1 | 50 | 600 | 850 | −5 | 850 | 500 | 0.051 | Present | Present |
| 73 | AF | 0.8 | 2.9 | 50 | 600 | 850 | −5 | 850 | 500 | 0.031 | Present | Present |
| 74 | AG | 0.8 | 1.9 | 50 | 600 | 850 | −5 | 850 | 500 | 0.046 | Present | Present |
| 75 | AH | 0.8 | 2.1 | 50 | 600 | 850 | −5 | 850 | 500 | 0.033 | Present | Present |
| 76 | AI | 0.8 | 2.1 | 50 | 600 | 850 | −5 | 850 | 500 | 0.041 | Present | Present |
| 77 | AJ | 0.8 | 2.1 | 50 | 600 | 850 | −5 | 850 | 500 | 0.031 | Present | Present |
| 78 | AK | 0.8 | 1.9 | 50 | 600 | 850 | −5 | 850 | 500 | 0.026 | Present | Present |
| 79 | AL | 0.8 | 2.2 | 50 | 600 | 850 | −5 | 850 | 500 | 0.023 | Present | Present |
| 80 | AM | 0.8 | 2.0 | 50 | 600 | 850 | −5 | 850 | 500 | 0.029 | Present | Present |
| 81 | AN | 0.8 | 2.1 | 50 | 600 | 850 | −5 | 850 | 500 | 0.034 | Present | Present |
| 82 | AO | 0.8 | 2.1 | 50 | 600 | 850 | −5 | 850 | 500 | 0.033 | Present | Present |
| 83 | AP | 0.8 | 1.9 | 50 | 600 | 850 | −5 | 850 | 500 | 0.027 | Present | Present |
| 84 | AQ | 0.8 | 2.2 | 50 | 600 | 850 | −5 | 850 | 500 | 0.026 | Present | Present |
| 85 | AR | 2.1 | 2.0 | 50 | 600 | 850 | −5 | 850 | 500 | 0.226 | Present | Present |
| 86 | AS | 0.8 | 3.1 | 50 | 600 | 850 | −5 | 850 | 500 | 0.053 | Present | Present |
| 87 | AT | 0.8 | 2.1 | 50 | 600 | 850 | −5 | 850 | 500 | 0.025 | Present | Present |
| 88 | AU | 0.8 | 2.1 | 50 | 600 | 850 | −5 | 850 | 500 | 0.019 | Present | Present |
| 89 | AV | 0.8 | 2.1 | 50 | 600 | 850 | −5 | 850 | 500 | 0.022 | Present | Present |

| No. | Mass per unit area ($g/m^2$) | Plating type | Content of Fe in plating layer (% by mass) | Coating appearance | Exfoliation resistance | TS (MPa) | EI (%) | TS × EI | Workability | Classification |
|---|---|---|---|---|---|---|---|---|---|---|
| 42 | 40 | GA | 10 | B | B | 995 | 23.5 | 23383 | Good | Comparative example |
| 43 | 40 | GA | 10 | B | B | 993 | 22.4 | 22243 | Good | Comparative example |
| 44 | 40 | GA | 10 | A | B | 997 | 23.8 | 23729 | Good | Inventive example |
| 45 | 40 | GA | 10 | A | A | 1044 | 22.0 | 22968 | Good | Inventive example |
| 46 | 40 | GA | 10 | A | A | 1039 | 21.9 | 22754 | Good | Inventive example |
| 47 | 40 | GA | 10 | A | B | 1045 | 22.5 | 23513 | Good | Inventive example |
| 48 | 40 | GA | 10 | A | B | 1048 | 21.4 | 22427 | Good | Inventive example |
| 49 | 40 | GA | 10 | A | B | 1050 | 20.9 | 21945 | Good | Inventive example |
| 50 | 40 | GA | 10 | B | B | 1051 | 21.6 | 22702 | Good | Comparative example |
| 51 | 40 | GA | 10 | A | A | 1150 | 16.3 | 18745 | Good | Inventive example |
| 52 | 40 | GA | 10 | A | A | 1163 | 15.3 | 17794 | Not good | Comparative example |
| 53 | 40 | GA | 10 | B | B | 1042 | 21.5 | 22403 | Good | Comparative example |
| 54 | 40 | GA | 10 | B | B | 1046 | 22.3 | 23326 | Good | Comparative example |
| 55 | 40 | GA | 10 | A | C | 1036 | 20.9 | 21652 | Good | Comparative example |

TABLE 4-continued

| | | | | | | | | | | |
|---|---|---|---|---|---|---|---|---|---|---|
| 56 | 40 | GA | 10 | A | A | 1029 | 20.4 | 20992 | Good | Inventive example |
| 57 | 40 | GA | 10 | A | A | 1048 | 20.7 | 21694 | Good | Inventive example |
| 58 | 40 | GA | 10 | A | A | 1041 | 21.6 | 22486 | Good | Inventive example |
| 59 | 60 | GI | 1 | A | B | 1046 | 21.5 | 22489 | Good | Inventive example |
| 60 | 60 | GI | 1 | A | B | 1032 | 20.7 | 21362 | Good | Inventive example |
| 61 | 60 | GI | 1 | A | B | 1039 | 21.5 | 22339 | Good | Inventive example |
| 62 | 60 | GI | 1 | A | D | 1047 | 21.8 | 22825 | Good | Comparative example |
| 63 | 60 | GI | 1 | A | B | 1045 | 20.4 | 21318 | Good | Inventive example |
| 64 | 80 | GI | 1 | A | B | 1162 | 20.6 | 23937 | Good | Inventive example |
| 65 | 100 | GI | 1 | A | B | 1042 | 21.6 | 22507 | Good | Inventive example |
| 66 | 40 | GA | 7 | A | A | 1038 | 21.4 | 22213 | Good | Inventive example |
| 67 | 40 | GA | 12 | A | A | 1033 | 21.5 | 22210 | Good | Inventive example |
| 68 | 40 | GA | 15 | A | A | 1045 | 20.7 | 21632 | Good | Inventive example |
| 69 | 50 | GA | 10 | A | A | 1043 | 20.9 | 21799 | Good | Inventive example |
| 70 | 40 | GA | 10 | A | A | 1047 | 21.6 | 22615 | Good | Inventive example |
| 71 | 40 | GA | 10 | A | A | 1036 | 22.5 | 23310 | Good | Inventive example |
| 72 | 40 | GA | 10 | A | A | 1040 | 22.1 | 22984 | Good | Inventive example |
| 73 | 40 | GA | 10 | A | A | 1042 | 20.5 | 21361 | Good | Inventive example |
| 74 | 40 | GA | 10 | A | A | 1035 | 21.9 | 22667 | Good | Inventive example |
| 75 | 40 | GA | 10 | A | A | 1253 | 15.6 | 19547 | Good | Inventive example |
| 76 | 55 | GA | 10 | A | A | 1038 | 20.3 | 21071 | Good | Inventive example |
| 77 | 40 | GA | 10 | A | A | 1033 | 21.5 | 22210 | Good | Inventive example |
| 78 | 40 | GA | 10 | A | A | 1036 | 21.3 | 22067 | Good | Inventive example |
| 79 | 40 | GA | 10 | A | A | 1039 | 20.5 | 21300 | Good | Inventive example |
| 80 | 40 | GA | 10 | A | A | 1047 | 20.3 | 21254 | Good | Inventive example |
| 81 | 40 | GA | 10 | A | A | 1044 | 20.9 | 21820 | Good | Inventive example |
| 82 | 40 | GA | 10 | A | A | 1029 | 22.1 | 22741 | Good | Inventive example |
| 83 | 50 | GA | 10 | A | A | 1036 | 21.5 | 22274 | Good | Inventive example |
| 84 | 40 | GA | 10 | A | A | 1301 | 13.5 | 17564 | Not good | Comparative example |
| 85 | 40 | GA | 10 | B | D | 1036 | 20.4 | 21134 | Good | Comparative example |
| 86 | 40 | GA | 10 | B | D | 1058 | 21.2 | 22430 | Good | Comparative example |
| 87 | 40 | GA | 10 | B | B | 1049 | 20.5 | 21505 | Good | Comparative example |
| 88 | 40 | GA | 10 | B | D | 1277 | 13.9 | 17750 | Not good | Comparative example |
| 89 | 40 | GA | 10 | A | B | 1028 | 17.5 | 17990 | Not good | Comparative example |

As is clear from Table 4, GIs and GAs (inventive examples) manufactured by a method according to embodiments of the present invention are high-strength steel sheets containing large amounts of oxidizable elements such as Si and Mn and, however, have excellent workability, excellent exfoliation resistance during heavy machining, and good coating appearance.

In comparative examples, one or more of coating appearance, workability, and exfoliation resistance during heavy machining are poor.

A high-strength galvanized steel sheet according to embodiments of the present invention is excellent in coating appearance, workability, and exfoliation resistance during heavy machining and can be used as a surface-treated steel sheet for allowing automobile bodies to have light weight and high strength. Furthermore, the high-strength galvanized steel sheet can be used as a surface-treated steel sheet, made by imparting rust resistance to a base steel sheet, in various fields such as home appliances and building materials other than automobiles.

The invention claimed is:

1. A method for manufacturing a high-strength galvanized steel sheet including a zinc plating layer, having a mass per unit area of 20 g/m$^2$ to 120 g/m$^2$, disposed on a steel sheet containing 0.01% to 0.18% C, 0.02% to 2.0% Si, 1.0% to 3.0% Mn, 0.001% to 1.0% Al, 0.005% to 0.060% P, and 0.01% or less S on a mass basis, the remainder being Fe and unavoidable impurities, the method comprising:

annealing and galvanizing the steel sheet in a continuous galvanizing line equipped with an all-radiant tube-type furnace, wherein the steel sheet is not oxidized prior to annealing, and setting the temperature of the all-radiant tube-type furnace such that the furnace temperature reaches a temperature region of A° C. and a temperature region of B° C. during the annealing and galvanizing process, wherein the annealing and galvanizing is performed at an atmosphere dew-point temperature of −5° C. or higher when the furnace temperature is in the regions of A° C. and B° C., and wherein the atmosphere dew-point temperature is −50° C. to −10° C. when the furnace temperature is outside the regions of A° C. and B° C., where $600 \leq A \leq 780$ and $800 \leq B \leq 900$.

2. The method for manufacturing the high-strength galvanized steel sheet according to claim 1, wherein the steel sheet further contains at least one or more selected from the group consisting of 0.001% to 0.005% B, 0.005% to 0.05% Nb, 0.005% to 0.05% Ti, 0.001% to 1.0% Cr, 0.05% to 1.0% Mo, 0.05% to 1.0% Cu, and 0.05% to 1.0% Ni on a mass basis as a component composition.

3. The method for manufacturing the high-strength galvanized steel sheet according to claim 1, further comprising alloying the steel sheet by heating the steel sheet to a temperature of 450° C. to 600° C. after galvanizing such that the content of Fe in the zinc plating layer is within a range from 7% to 15% by mass.

4. The method for manufacturing the high-strength galvanized steel sheet according to claim 1, wherein the step of annealing and galvanizing the steel sheet with the furnace temperature of A° C. to B° C. is performed at an atmosphere dew-point temperature of −5° C.

* * * * *